US007066105B2

(12) United States Patent
Tal

(10) Patent No.: US 7,066,105 B2
(45) Date of Patent: Jun. 27, 2006

(54) PLASTIC FLAG FOR DISPLAYING MESSAGES, ADVERTISEMENTS, AND THE LIKE

(76) Inventor: Yaron Tal, 8135 Remmet Ave., Canoga Park, CA (US) 91304

( * ) Notice: Subject to any disclaimer, the term of this patent is extended or adjusted under 35 U.S.C. 154(b) by 0 days.

(21) Appl. No.: 10/340,276

(22) Filed: Jan. 10, 2003

(65) Prior Publication Data

US 2004/0134410 A1 Jul. 15, 2004

(51) Int. Cl.
*G09F 17/00* (2006.01)

(52) U.S. Cl. ..... 116/28 R; 116/173; 40/591

(58) Field of Classification Search ..... 116/28 R, 116/173, 174, 175; 40/588, 589, 591
See application file for complete search history.

(56) References Cited

U.S. PATENT DOCUMENTS

| | | | | | |
|---|---|---|---|---|---|
| 1,744,196 | A | * | 1/1930 | Ames | 248/539 |
| 2,445,606 | A | * | 7/1948 | Davis | 248/539 |
| 2,546,855 | A | * | 3/1951 | Frame | 116/173 |
| 2,752,709 | A | * | 7/1956 | Gough | 40/591 |
| 2,764,122 | A | * | 9/1956 | Irvin | 116/173 |
| 2,856,891 | A | * | 10/1958 | Solomon | 116/173 |
| 2,922,152 | A | * | 1/1960 | Del Conte | 340/473 |
| 3,075,492 | A | * | 1/1963 | Winfrey | 116/28 R |
| 3,127,868 | A | * | 4/1964 | Guthrie | 116/173 |
| 3,158,132 | A | * | 11/1964 | Guthrie | 116/173 |
| 3,239,957 | A | * | 3/1966 | Snediker | 40/591 |
| 3,241,516 | A | * | 3/1966 | Hopkins | 116/173 |
| 3,262,414 | A | * | 7/1966 | Monk | 116/28 R |
| 3,715,821 | A | * | 2/1973 | Hawes | 40/591 |
| 3,895,348 | A | * | 7/1975 | Palermo | 340/472 |
| 3,972,302 | A | * | 8/1976 | Sherman | 116/28 R |
| 4,561,301 | A | * | 12/1985 | Steele | 73/170.05 |
| 4,590,883 | A | * | 5/1986 | Steed et al. | 116/173 |
| 4,686,785 | A | * | 8/1987 | Obbermito | 40/607.13 |
| 4,727,822 | A | * | 3/1988 | Wikkerink | 116/174 |
| 4,976,410 | A | * | 12/1990 | Tomaiuolo | 248/514 |
| 4,986,209 | A | * | 1/1991 | Spica | 116/28 R |
| 5,233,938 | A | * | 8/1993 | Lalo | 116/173 |
| 5,299,525 | A | * | 4/1994 | Romesburg | 116/173 |
| 5,363,792 | A | * | 11/1994 | Petechik | 116/28 R |
| D363,249 | S | * | 10/1995 | Castillo | D10/109 |
| 5,463,974 | A | | 11/1995 | Seeder | |
| 5,483,916 | A | | 1/1996 | Kolvites et al. | |
| 5,872,510 | A | * | 2/1999 | O'Shaughnessy | 340/468 |
| 5,881,481 | A | * | 3/1999 | Bashaw et al. | 40/593 |
| 6,010,107 | A | * | 1/2000 | Goldfarb | 248/512 |
| D420,308 | S | * | 2/2000 | Turok | D11/166 |
| 6,085,687 | A | * | 7/2000 | Chester | 116/173 |
| 6,276,080 | B1 | * | 8/2001 | Brennan | 40/591 |
| 6,609,476 | B1 | * | 8/2003 | Lorenzana et al. | 116/173 |
| 6,637,365 | B1 | * | 10/2003 | Adamski | 116/28 R |

* cited by examiner

*Primary Examiner*—Diego Gutierrez
*Assistant Examiner*—Amy R. Cohen
(74) *Attorney, Agent, or Firm*—Bruce Fertel; Howard Hoffenberg

(57) ABSTRACT

Display devices in the shape of a flag assembly are provided. The display devices are constructed of solid plastic materials that withstand damage caused by contact with air turbulence or adverse weather conditions, particularly when attached to a mount on a moving vehicle, and that withstand detachment from a mount caused by such air turbulence or adverse weather conditions. The display devices allow an observer to openly view a display when a vehicle is stationary or moving, and allow a motorist of another vehicle to view the display while having an unobstructed view of traffic conditions surrounding the vehicle.

2 Claims, 3 Drawing Sheets

PLASTIC FLAG FOR DISPLAYING MESSAGES, ADVERTISEMENTS, AND THE LIKE

FIELD OF THE INVENTION

The present invention relates to the field of display devices.

BACKGROUND OF THE INVENTION

Flags are commonly displayed on vehicles to convey messages, advertisements, slogans, origin of country, and other means of communication. These types of flags generally are attached to a flag attachment device, which further attaches to a vehicle, usually at a top portion of a car window. Examples of flag attachment devices include: U.S. Pat. No. 5,463,974 to Seeder (1995), which discloses a flag mount that attaches to a flag assembly by means of two spring legs at one end of the flag assembly, and U.S. Pat. No. 5,483,916 to Kolvites et al. (1996), which discloses a flag display device that attaches to a mount by means of a base member, a plurality of legs, and a suction cup. Flags of this nature consist of many parts, making the cost of producing them expensive. In addition, the types of flags that attach to these attachment devices are generally comprised of a flat, yet flexible piece of material such as cloth. Since this type of material bends and forms waves created by air turbulence surrounding a moving vehicle, the cloth material creates distortion of the flag's message, such that an observer has difficulty observing and understanding the flag's intended message.

It is therefore apparent that there exists a need in the art for an improved flag assembly that displays an intended form of communication more effectively, is relatively inexpensive to manufacture due to a minimal number of parts, and is sufficiently durable to withstand damage caused by air turbulence and exposure to adverse weather conditions.

SUMMARY OF THE INVENTION

The present invention provides a display device that is constructed of a solid plastic material that can withstand damage caused by contact with air turbulence and adverse weather conditions. The display device is comprised of a plastic flag and a plastic flag attachment that is connected in between the plastic flag and a mount, the mount being a place of attachment of the display device to a solid object.

The plastic flag attachment contains a portion that attaches to the plastic flag and a clip portion that allows the display device to remain connected to the mount when contacted by the air turbulence. The clip portion may constructed so that it may slide into a mount, or it may be constructed so that it is opened and closed by a lever and "pinches" the mount.

The display device may be constructed of one continuous piece of material; two pieces of material, one piece being the plastic flag attachment, and the other piece being the plastic flag; or three pieces of material, the third additional piece being a plastic connector. The present invention may also have a plastic flag that pivots circumferentially around an axis defined by the length of the plastic flag attachment. Display devices containing two pieces of solid plastic material may accomplish the pivot, or display devices containing the additional plastic connector may accomplish the pivot.

The construction of the display device also allows for a display on the plastic flag to be in a position to be openly viewed when the vehicle is stationary or moving, and allows an observer of the display device to have an obstructed view of traffic conditions surrounding the vehicle.

DETAILED DESCRIPTION OF THE INVENTION

Figure 1:
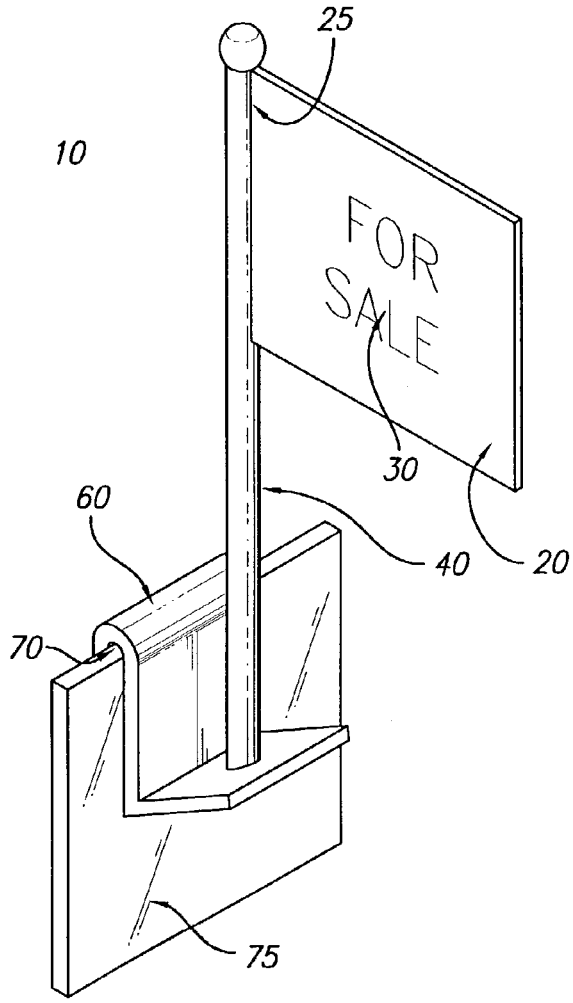
FIG. 1 is a perspective view of a first aspect of the invention, showing a display device that is comprised of one piece of material.

Referring to FIG. 1, a display device 10, in the shape of a flag assembly is comprised of one piece of solid plastic material. The display device 10 is compartmentalized into a plastic flag 20 onto which a display 30 is shown. The plastic flag 20 is attached to a plastic flag attachment 40, and since the display device 10 is one piece of material, the plastic flag attachment 40 is merely a continuation of the plastic flag 20 at an area 25. The plastic flag attachment 40 also has a clip portion 60 that removably attaches to a mount 75 through an interior area 70 of the clip portion 60 of the flag attachment 40.

Figure 2:
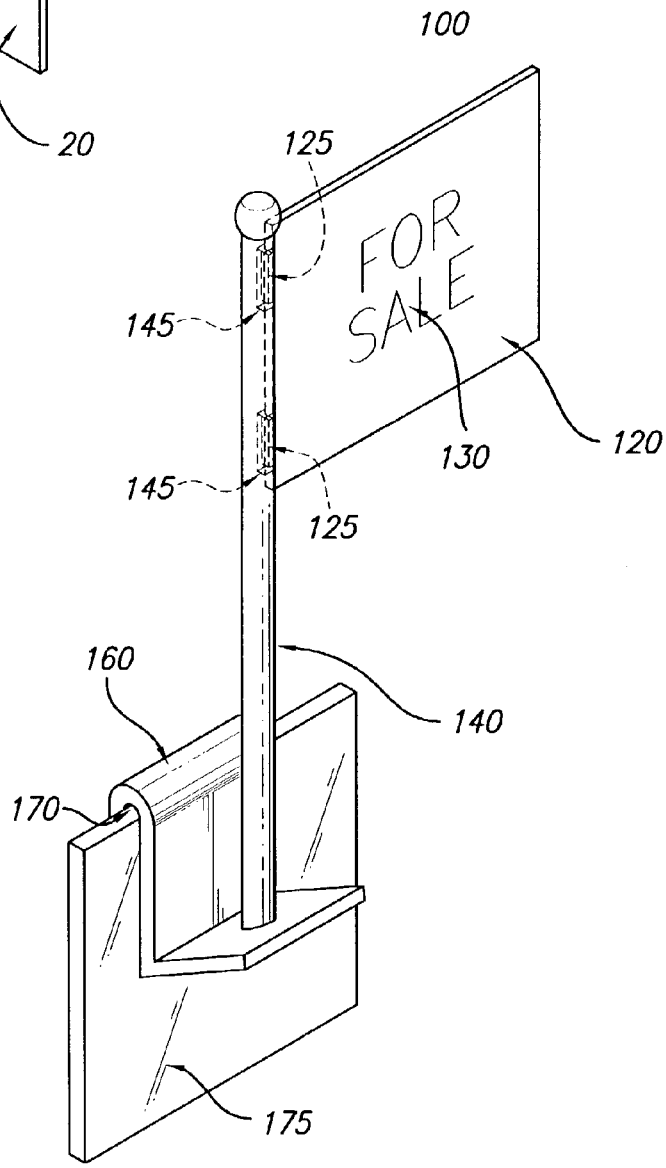
FIG. 2 is a perspective view of a second aspect of the invention, showing a display device that is comprised of two pieces of material.

Referring to FIG. 2, an embodiment of the invention is represented by a display device 100 in the shape of a flag assembly and is comprised of two pieces of solid plastic material: a plastic flag 120 onto which a display 130 is shown, and a plastic flag attachment 140. The plastic flag 120 contains a pair of lips 125 that connects, preferably by snapping, into the plastic flag attachment 140 by through a pair of notches 145 in the plastic flag attachment 140. The design of the plastic flag attachment 140 is similar to the plastic flag attachment 40 in FIG. 1, in which a clip portion 160 of the flag attachment 140 connects to a mount 175 through an interior area 170 of the clip portion 160.

Figure 3:
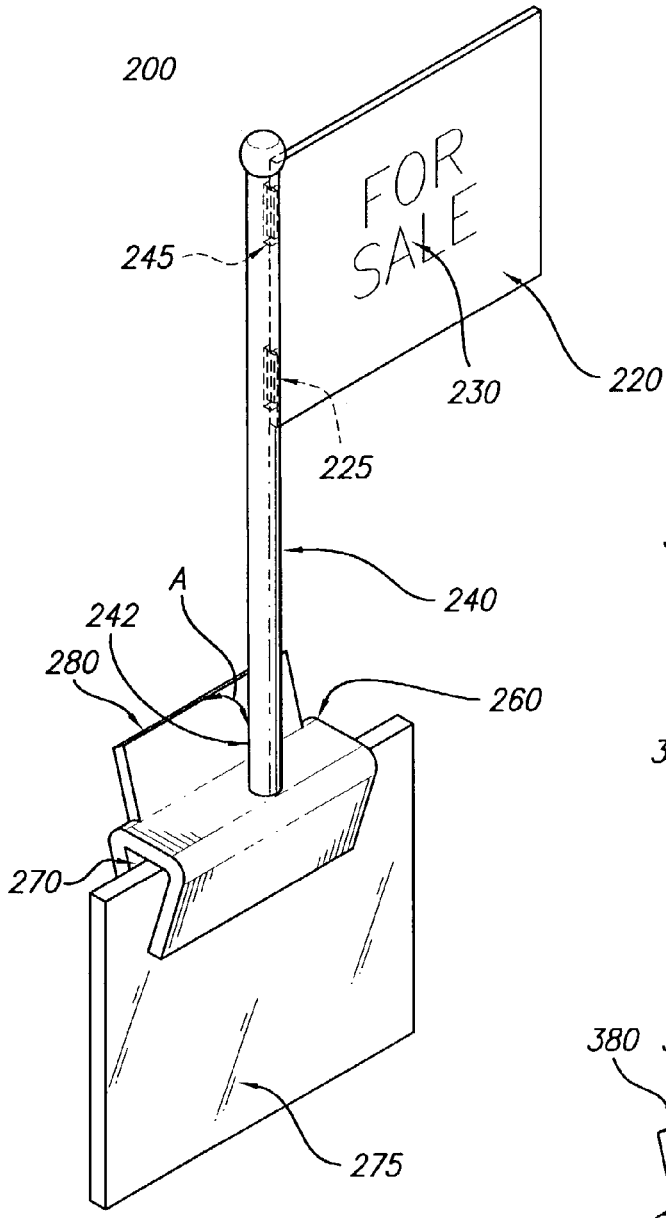
FIG. 3 is a perspective view of a third aspect of the invention, showing a display device that is comprised of two pieces of material, and having a differently shaped clip portion.

In FIG. 3, another embodiment of the invention is represented by a display device 200 in the shape of a flag assembly. The display device, as in FIG. 2, is comprised of two pieces of solid plastic material, a plastic flag 220 onto which a display 230 is shown and a plastic flag attachment 240. The plastic flag 220 contains a pair of lips 225 that connects, preferably by snapping, into the plastic flag attachment 240 through a pair of notches 245 in the plastic flag attachment 240. The clip portion 260 of the flag attachment 240 attaches to a mount by means of a lever 280. The lever 280 is pinched toward a bottom portion 242 of the plastic flag attachment 240, as represented by arrow A, so that a mount 275 may enter the clip portion 260 in an interior area 270. The lever 280 is then released (as represented by the opposing direction of arrow A) so that the clip portion 260 pinches the mount 275.

Figure 4:
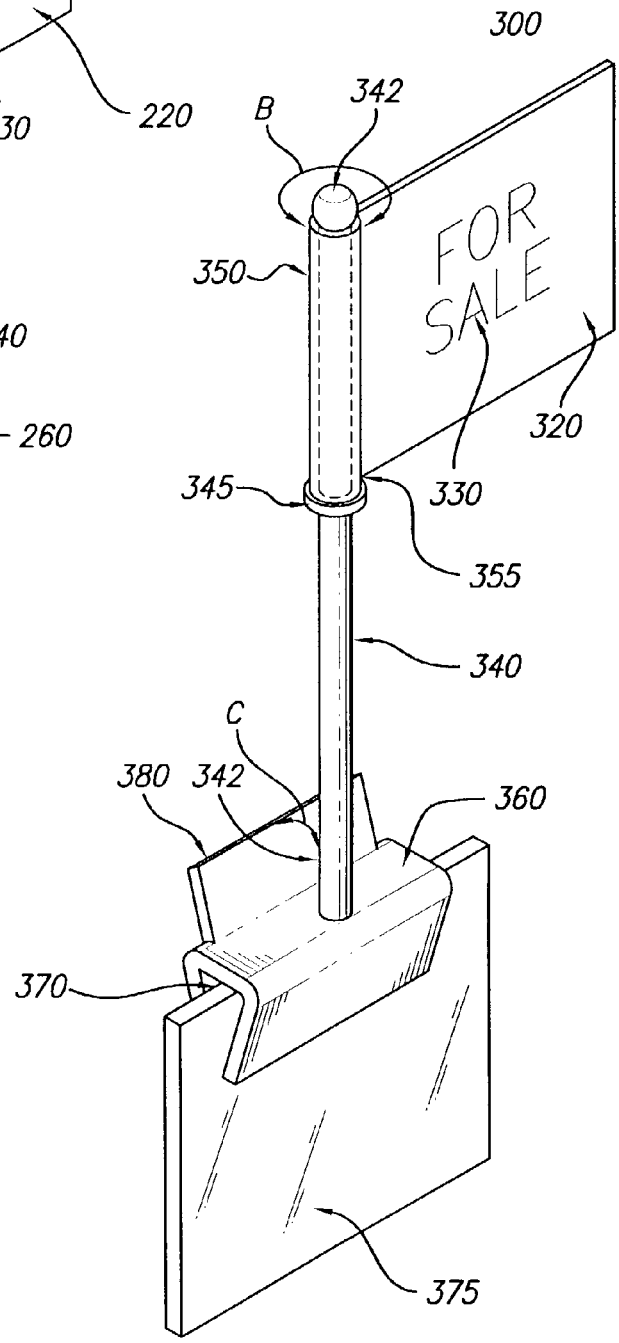
FIG. 4 is a perspective view of a fourth aspect of the invention, showing a pivotable display device that is comprised of two pieces of material.

In FIG. 4, another embodiment of the invention is represented by a display device 300 in the shape of a flag assembly. The display device is comprised of two pieces of solid plastic material, a plastic flag 320 onto which a display 330 is shown and a plastic flag attachment 340. The plastic flag 320 contains a plastic connector portion 350 in the shape of a hollow tube, in which the plastic connector portion 350 is merely a continuation of the plastic flag 320 at an area 355 and comprises one continuous piece of material. The plastic connector portion 350 connects to the plastic flag attachment 340 by sliding the interior of the tube over a first knob 342 and resting on a second knob 345. The plastic connector portion 350 is attached to the plastic flag attachment 340 with a balance of rigidity and flexibility such that the plastic flag 320 can be stable in one position, yet may be manually rotated circumferentially (both clockwise and counterclockwise) around an axis defined by the length of the plastic flag attachment 340 as shown by arrow B. The clip portion 360 of the flag attachment 340 attaches to a mount 375 by means of a lever 380. The lever 380 is pinched in the direction toward a bottom portion 342 of the plastic flag attachment 340, as represented by arrow C, so that the mount 375 may enter the clip portion 360 in an interior area 370 of the clip portion 360. The lever 380 is then released (as represented by the opposing direction of arrow C) so that the clip portion 260 pinches the mount 275.

Figure 5:
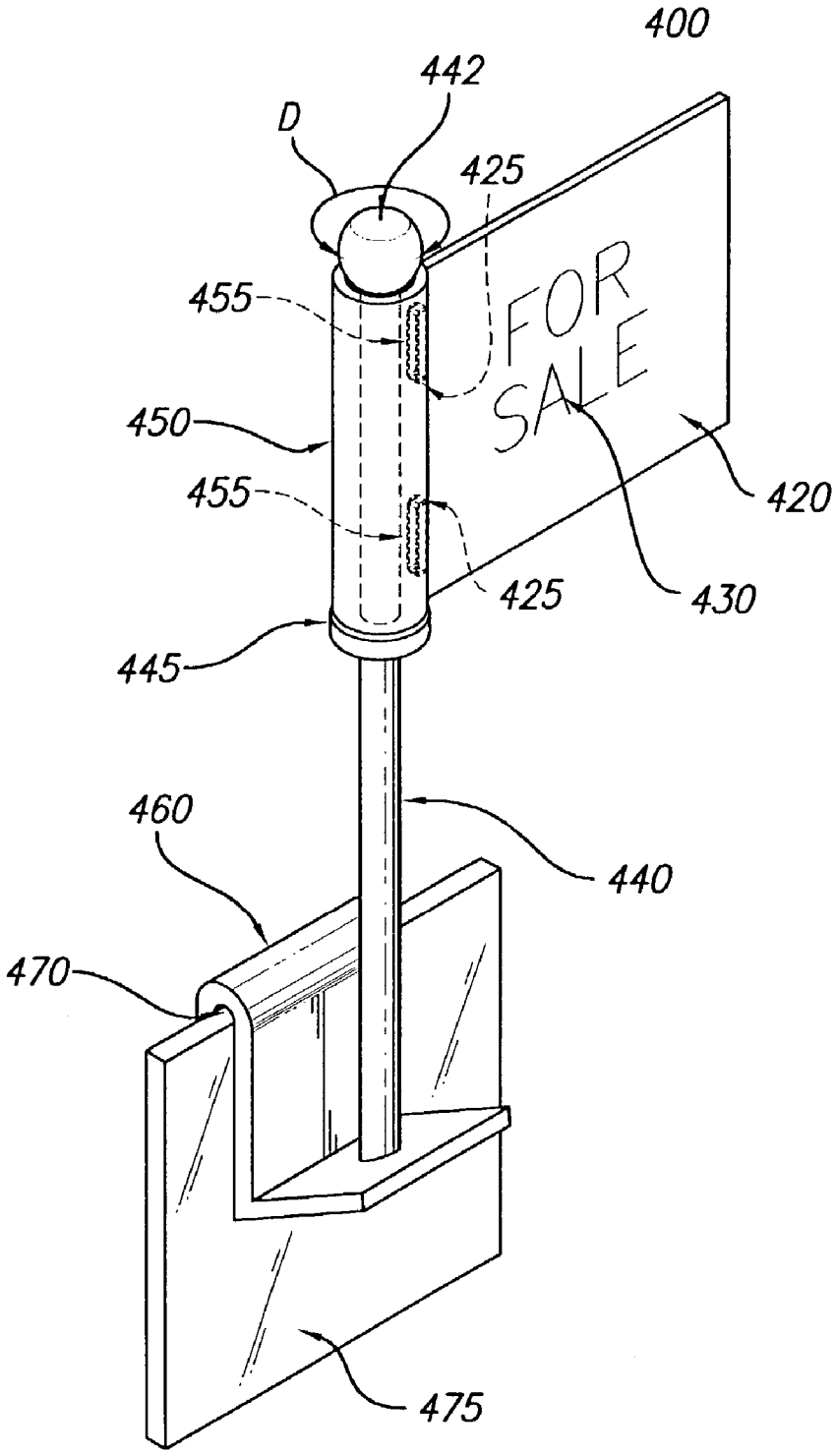
FIG. 5 is perspective view of a fourth aspect of the invention, showing a pivotable display device that is comprised of three pieces of material.

In FIG. 5, an embodiment of the present invention is represented by a display device 400 that contains three pieces of solid plastic material: a plastic flag 420, a plastic connector 450, and a plastic flag attachment 440. The plastic flag attachment 440 has a clip portion 460 that removably attaches to a mount 475 through an interior area 470 of the clip portion 460. The plastic connector 450 is the shape of a hollow tube that connects to the plastic flag attachment 440 by sliding the interior of the tube over a first knob 442 and resting on a second knob 445 on the plastic flag attachment 440. The plastic flag 420, onto which a display 430 is shown, contains a pair of lips 425 that attaches to the plastic connector 450 through a pair of slots 455 in the plastic connector 450. The pair of lips 425 on the plastic flag 420 extends outward to a distance great enough to connect, preferably by snapping, into the pair of slots 455 in the plastic connector 450, yet small enough to avoid contact with the plastic flag attachment 440. The plastic connector 450 is attached to the plastic flag attachment 440 with a balance of rigidity and flexibility such that the plastic flag 420 can be stable in one position, yet may be manually rotated circumferentially (both clockwise and counterclockwise) around an axis defined by the length of the plastic flag attachment 440 as shown by arrow D.

It is contemplated that the display device may be mounted onto any surface to which the clip portion has the ability to grip. It is further contemplated that the display device of the present invention will be used for purposes of presenting messages, advertisements, slogans, and the like to the general public. Since the display device is contemplated to be placed on a mount that will be seen by the public, it is contemplated that the mount may be a top portion of a vehicle window. Since the vehicle will be seen mostly when in motion, for example, when being driven on a road in a downtown area of a city, the display device of the present invention is constructed of a solid, durable plastic material that can withstand damage caused by turbulence created by the moving vehicle. Further, the solid plastic material used in the present invention contributes to the clip portion of the plastic flag attachment having a strong enough grip on the mount to avoid detachment from the moving vehicle, particularly at high speeds or during adverse weather conditions including, but not limited to: wind, rain, snow, sleet, and hail. Although all of the embodiments of the present invention provide a strong enough grip to prevent detachment of the display device from a moving vehicle, the "lever-type" clip portion shown in FIGS. 3 and 4 provide the strongest grip and are preferably used in the construction of the present invention.

It is also contemplated that the display device of the present invention will be constructed so that a desired display will be easily open to public view so the desired display will be observed and understood by a target audience. Parameters that may be may be adjusted to attract the awareness of an audience include the size, shape, and color of the plastic flag as well as the direction the plastic flag is facing. For example, if a pizza owner wants to target an audience to sell pizza, an advertisement may be placed on the display device in the form of a triangular-shaped plastic flag, that is, a plastic flag shaped like a slice of pizza. In addition, the triangular plastic flag may contain the colors of a typical slice of pizza to further attract the target audience. If the pizza owner desires the advertisement to be viewed by an observer at various angles when mounted on a vehicle, the display device as described in either FIGS. 4 or 5 may be used so that the plastic flag has the ability to pivot in various directions until a desired position is achieved. It is because of the increased viewing ability of a pivotable display device, that the pivotable display devices are contemplated to be the preferred embodiments of the present invention.

It is further contemplated that the display device of the present invention will be constructed so that it will not obstruct the flow of traffic when it is mounted on a moving vehicle. Again, the size and shape of the plastic flag may be adjusted on a vehicle, such that a motorist in a second vehicle may see and understand a display on the display device, yet have an unobstructed view of traffic conditions surrounding the display device, and therefore safely drive the second vehicle.

Thus, while specific embodiments and applications of this invention have been shown and described, it would be apparent to those skilled in the art that many more modifications are possible without departing from the inventive concepts herein. The invention, therefore, is not to be restricted except in the spirit of the appended claims.

The invention claimed is:

1. A display device for attachment to a automobile having a mount that is operative when the automobile is stationary and moving comprising:

a. a solid plastic flag attachment having a:
   i. clip portion;
   ii. an interior area of the clip portion
   iii. a pole extending from the clip portion and
   iv. a lever extending from the clip portion that is opposed to the pole where the lever is pinched with and toward the pole so that the mount may enter the clip portion in the interior area and the lever is then released so that the clip portion pinches the mount with a strong enough grip to avoid detachment when the automobile is moving and b. a solid plastic flag having a display that is a separate piece of material from the solid plastic flag attachment and is sufficiently durable to hold up at high speeds to withstand damage caused by air turbulence and to hold up to adverse whether conditions including wind, rain, snow, sleet and hail and provide for visibility of the display when the automobile is stationary, where the attachment of the solid plastic flag to the pole consists of the solid plastic flag having two lips and the pole of the solid plastic flag attachment having two notches so that the two lips of the solid plastic flag connect to the two notches of the pole of the solid plastic flag attachment, where the solid plastic flag has a plastic connector portion that pivotally connects to the pole of the solid plastic flag attachment, and further comprising a first knob and second knob spaced apart on the pole and the plastic connector is situated between the first and second knobs.

2. A display device for attachment to a automobile having a mount that is operative when the automobile is stationary and moving comprising:

a. a solid plastic flag attachment having a:

i. clip portion;

ii. an interior area of the clip portion:

i. a pole extending from the clip portion having

A. a first knob and

B. a second knob spaced apart from the first knob and ii. a lever extending from the clip portion that is opposed to the bottom portion of the pole where the lever is pinched with and toward the pole so that the mount may enter the clip portion in the interior area and the lever is then released so that the clip portion pinches the mount with a strong enough grip to avoid detachment when the automobile is moving and b. a solid plastic flag having a iii. a display and iv. a plastic connector attached to the display where the attachment consists of the solid plastic flag having a pair of lips and the plastic connector having a pair of slots, and the display is connected to the plastic connector by snapping the lips into the slots and the connector is pivotally connected to the pole between the first and second knobs, where the plastic is sufficiently durable to hold up at high speeds to withstand damage caused by air turbulence and to hold up to adverse whether conditions including wind, rain, snow, sleet and hail and provide for visibility of the display when the automobile is stationary.

* * * * *